United States Patent [19]

Connell

[11] 4,270,599

[45] Jun. 2, 1981

[54] TUBE SUPPORT STRUCTURE FOR A FLUIDIZED BED HEAT EXCHANGER

[75] Inventor: John M. Connell, Mt. Lakes, N.J.

[73] Assignee: Foster Wheeler Energy Corporation, Livingston, N.J.

[21] Appl. No.: 946,937

[22] Filed: Sep. 29, 1978

[51] Int. Cl.[3] ..... F28D 13/00

[52] U.S. Cl. ..... 165/104.16; 165/162; 422/143

[58] Field of Search ..... 165/104 F, 162, 172; 34/57 A; 122/4 D; 248/49; 422/143, 146; 110/263

[56] References Cited

U.S. PATENT DOCUMENTS

| | | | |
|---|---|---|---|
| 510,788 | 12/1893 | Hawkins | 110/232 |
| 2,067,671 | 1/1937 | Kooistra | 165/162 X |
| 2,139,367 | 12/1938 | Kearney | 165/172 X |
| 2,695,220 | 11/1954 | Bergstrom | 165/162 X |
| 2,876,975 | 3/1959 | Short | 165/104 F X |
| 2,914,388 | 11/1959 | Kelley | 422/200 |
| 2,931,711 | 4/1960 | Walker | 122/4 D |
| 3,361,197 | 1/1968 | Mathews | 165/162 |
| 3,387,590 | 6/1968 | Bishop | 122/4 D |
| 3,482,946 | 12/1969 | Shirk | 165/162 X |
| 3,896,874 | 7/1975 | Bongaards et al. | 165/162 X |
| 3,898,043 | 8/1975 | Schutte et al. | 165/104 F X |
| 3,912,002 | 10/1975 | Elliott | 165/104 F |
| 3,983,927 | 10/1976 | Steever et al. | 165/104 F X |

FOREIGN PATENT DOCUMENTS

| | | | |
|---|---|---|---|
| 2152401 | 4/1972 | Fed. Rep. of Germany | 165/104 F |
| 550984 | 6/1974 | Switzerland | 165/162 |

*Primary Examiner*—Stephen Marcus

*Attorney, Agent, or Firm*—Marvin A. Naigur; John E. Wilson; John J. Herguth, Jr.

[57] ABSTRACT

A fluidized bed heat exchanger in which a grid plate is supported in a housing for receiving a bed of particulate material, at least a portion of which is combustible. At least one perforated support pier projects from the surface of the grid plate and air is passed through the grid plate, the support pier and the material to fluidize the material. One or more heat exchange tubes extend within the housing and are supported by the support pier so that the air passing through the pier also passes over the tubes. Each tube extends in a serpentine relation to form a plurality of spaced parallel sections and a support structure is provided for supporting the sections relative to each other.

17 Claims, 10 Drawing Figures

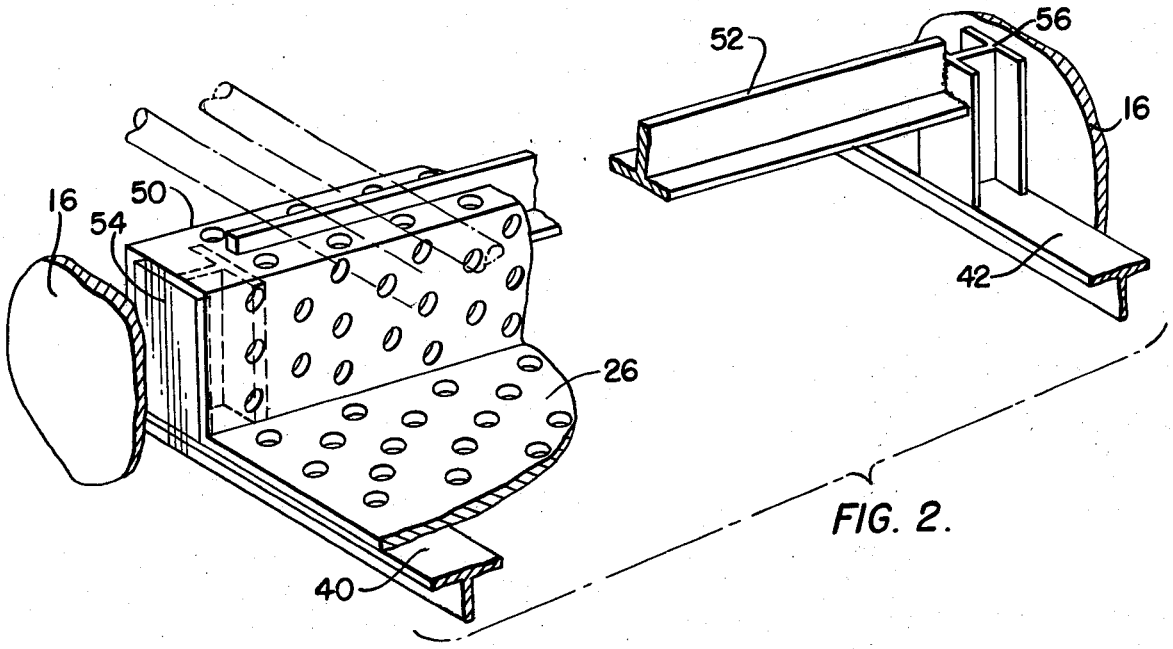
FIG. 2.
FIG. 4.
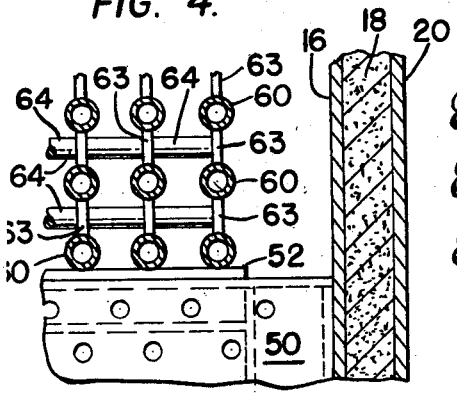
FIG. 5.
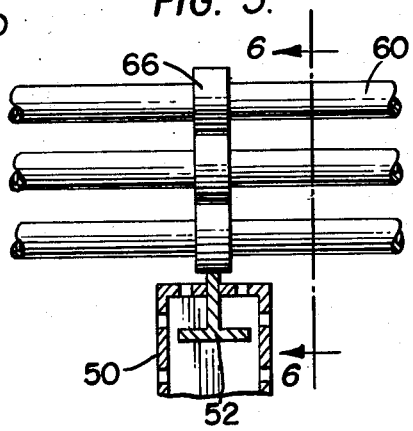
FIG. 6.
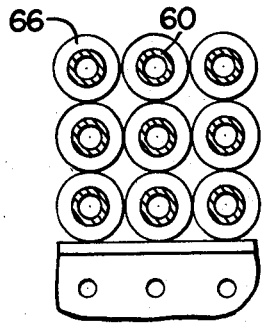
FIG. 7.
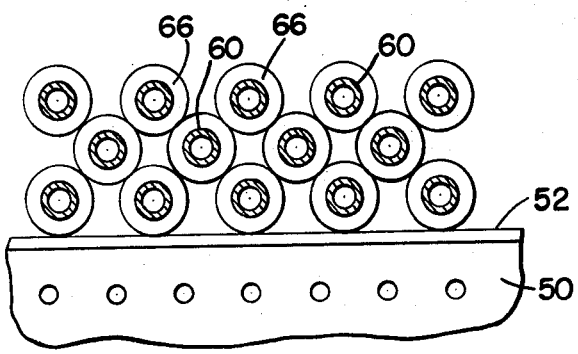

TUBE SUPPORT STRUCTURE FOR A FLUIDIZED BED HEAT EXCHANGER

BACKGROUND OF THE INVENTION

The present invention relates to a fluidized bed heat exchanger and, more particularly, to a support structure for supporting heat exchange tubes in the heat exchanger and for supporting the various sections of the tubes relative to each other.

The use of fluidized beds has been recognized as an attractive means of generating heat in a heat exchanger such as a boiler, a combustor, a gasifier, or the like. In these arrangements, air is passed through a bed of particulate material which normally consists of a mixture of inert material and a fossil fuel such as coal to fluidize the bed and to promote the combustion of the fuel. When the heat produced by the fluidized bed is utilized to convert water to steam such as in a steam generator, for example, the fluidized bed system offers an attractive combination of high heat release, improved heat transfer to surfaces within the bed and compact size.

In these type arrangements, a plurality of heat exchange tubes are usually connected to an external inlet header and extend in a serpentine relationship within the housing of the heat exchanger. The tubes are normally supported in an elevated position slightly above the grid plate of the heat exchanger by a refractory pier support, or the like. However, the latter does not permit an adequate flow of air, which normally flows through the grid, to those portions of the tubes which rest on the supports. Therefore, the latter tube portions become excessively hot and can lead to premature failure and hot spots within the bed. Also, if the tube sections extend across the bed for a relatively large distance, they tend to sag at their end portions and therefore do not attain a perfectly horizontal position within the housing which is important for optimum efficiency of the heat exchange process.

SUMMARY OF THE INVENTION

It is therefore an object of the present invention to provide a fluidized bed heat exchanger in which the heat exchange tubes are supported above the grid plate in a manner to permit cooling air to flow over those portions of the tubes supported relative to the grid plate.

It is a further object of the present invention to provide a heat exchanger of the above type in which the various sections of the heat exchange tubes are supported in a manner to prevent sagging of the sections.

Toward the fulfillment of these and other objects, the apparatus of the present invention includes a grid plate supported in a housing for receiving a bed of particulate material at least a portion of which is combustible. At least one perforated support pier projects out from the surface of the grid plate and air is passed through the grid plate, the support pier and the material to fluidize the material. A plurality of heat exchange tubes extend within the housing and are supported by the support pier so that the air passing through the pier also passes over the tubes. A ladder type support structure is provided between adjacent tube sections to support the sections relative to each other.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein:

FIG. 2 is an enlarged perspective view of a portion of the structure shown in FIG. 1;

FIG. 4 is a cross-sectional view taken along the line 4—4 of FIG. 3;

FIG. 5 is a partial view similar to FIG. 3 but depicting an alternate embodiment of the present invention;

FIG. 6 is a cross-sectional view taken along the line 6—6 of FIG. 5;

FIG. 7 is a view similar to FIG. 6 but showing another alternative embodiment of the present invention;

DESCRIPTION OF THE PREFERRED EMBODIMENTS

Figure 1:
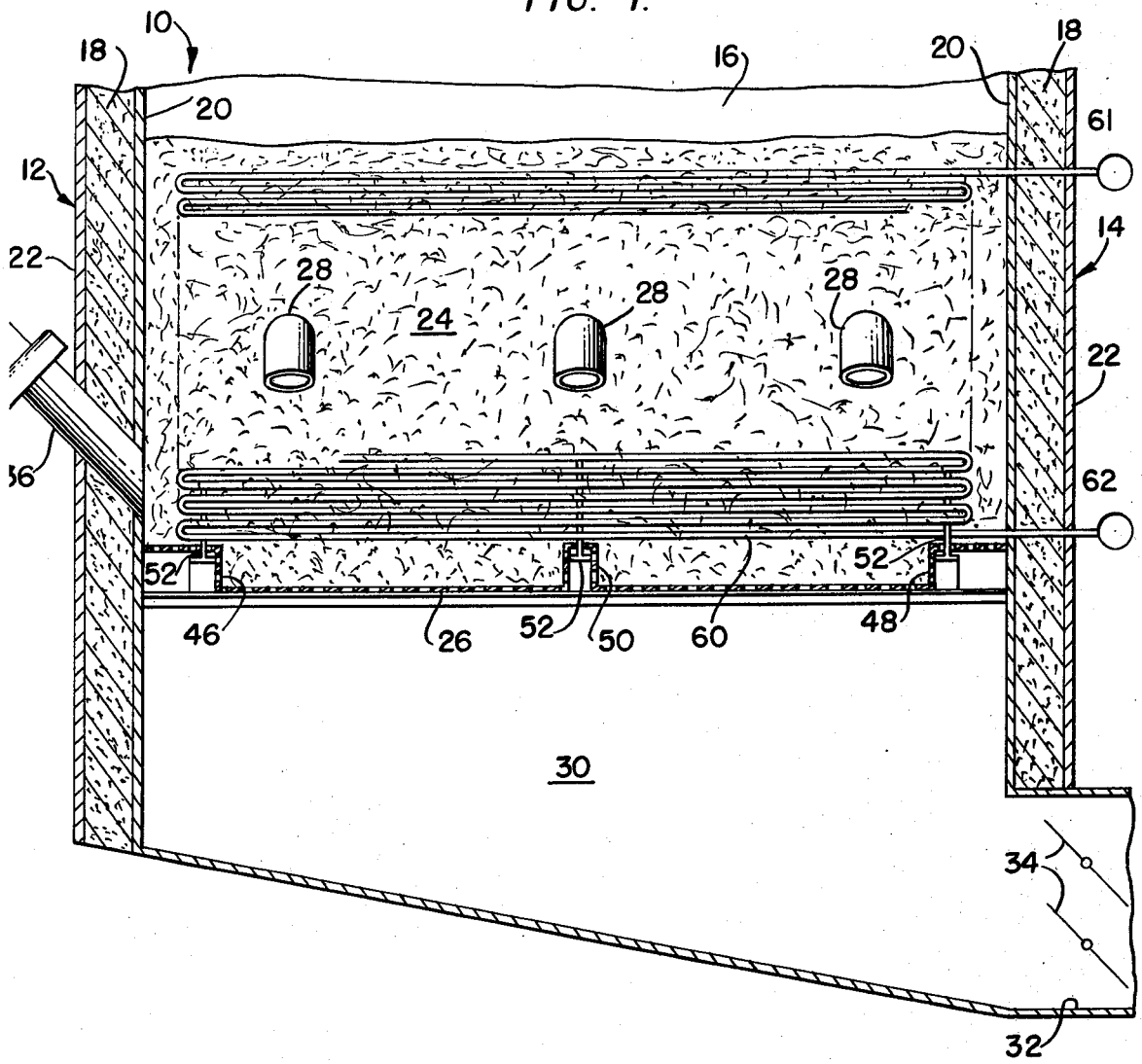
FIG. 1 is a vertical sectional view of a portion of a fluidized bed unit incorporating features of the present invention.

Referring specifically to FIG. 1 of the drawings, the present invention will be described in connection with a fluidized bed boiler, shown in general by the reference numeral 10 and consisting of a front wall 12, a rear wall 14, and two sidewalls, one of which is shown by the reference numeral 16. Each wall consists of a layer of insulation material 18 extending between an inner plate 20 and an outer sheathing 22. The upper portion of the boiler is not shown for the convenience of presentation it being understood that it consists of a convection section, a roof and an outlet for allowing the combustion gases to discharge from the boiler in a conventional manner.

A bed of particulate material, shown in general by the reference numeral 24, is disposed within the boiler 10 and rests on a perforated grid plate 26 disposed in the lower portion of the boiler. The bed 24 can consist of a mixture of discrete particles of inert material and fuel material such as bituminous coal which are introduced into the bed through feeders 28 extending through one of the sidewalls 16.

An air plenum chamber 30 is provided immediately below the grid plate 26 and communicates with an air inlet 32 provided through the rear wall 14 for distributing air from an external source (not shown) to the chamber 30. A pair of dampers 34 are disposed in the inlet 32 and are adapted for pivotal movement about their centers in a conventional manner in response to actuation of external controls (not shown) to vary the effective opening in the inlet and thus control the flow of air through the inlet and into the compartment 30. A bed light-off burner 36 is mounted through the front wall 12 immediately above the grid plate 26 for initially lighting off the bed 24 during startup, in a conventional manner.

Referring to FIGS. 1 and 2, a pair of support beams 40 and 42 (FIG. 2) are mounted adjacent the sidewalls 16 for supporting the grid plate 26. As shown in FIG. 1, the grid plate 26 is bent near its edges adjacent the walls 12 and 14 and in an intermediate location intermediate said edges to form two support piers 46 and 48 extending along the latter edges and a support pier 50 extending midway between the two support piers 46 and 48. As better shown in FIG. 2, the support pier 50 is formed by bending the grid plate 26 upwardly, horizontally and then downwardly to form a hollow pier having a rectangular cross section which includes the perforations normally present on the flat portion of the grid plate 26.

As shown in FIG. 1, the support piers 46 and 48 are formed by bending the portions near the edges of the grid plate upwardly and then horizontally with the edge portions of the piers resting against the walls 12 and 14, respectively. As in the case of the pier 50 each pier 46 and 48 is hollow and includes the grid plate perforations.

Referring again to FIG. 2, a beam 52, having a cross-sectional shape in the form of an inverted "T", extends between, and is welded at its ends to, a pair of vertical support beams 54 and 56 which are connected to and extend upwardly from the support beams 40 and 42, respectively. The beam 52 extends within the support pier 50 with the upper flange of the beam extending through a slot formed through the upper surface of the pier and projecting outwardly from the latter surface.

As better shown in FIG. 1, a plurality of heat exchange tubes 60 extend across the boiler 10 immediately above the grid plate 26 and within the bed 24. The tubes 60 are connected between an inlet header 61 and an outlet header 62 for respectively supplying heat exchange fluid, such as water, to the tubes and for receiving the water after it is passed through the tubes.

As shown in FIG. 1, additional support beams 52 are provided in connection with the piers 46 and 48 and, although not shown in the drawings, it is understood that they extend between two vertical support beams which are constructed and disposed in a manner similar to the beams 54 and 56. The support beams 52 are located relative to the support piers 46 and 48 in the same manner as in the case of the support pier 50, with the upper flanges of the beams extending through slots formed through the upper surfaces of the piers and projecting outwardly from the latter surfaces.

Each heat exchange tube 60 extends in a serpentine relationship to form a plurality of spaced parallel sections with each section of each tube extending horizontally and parallel to the other sections of the other tubes and in horizontal alignment with the sections of the other tubes. The lower section of each tube 60 extends across the projecting upper flanges of the support beams 52 associated with the piers 46, 48 and 50 and the upper section of each tube is located slightly below the upper level of the bed 24.

Figure 3:
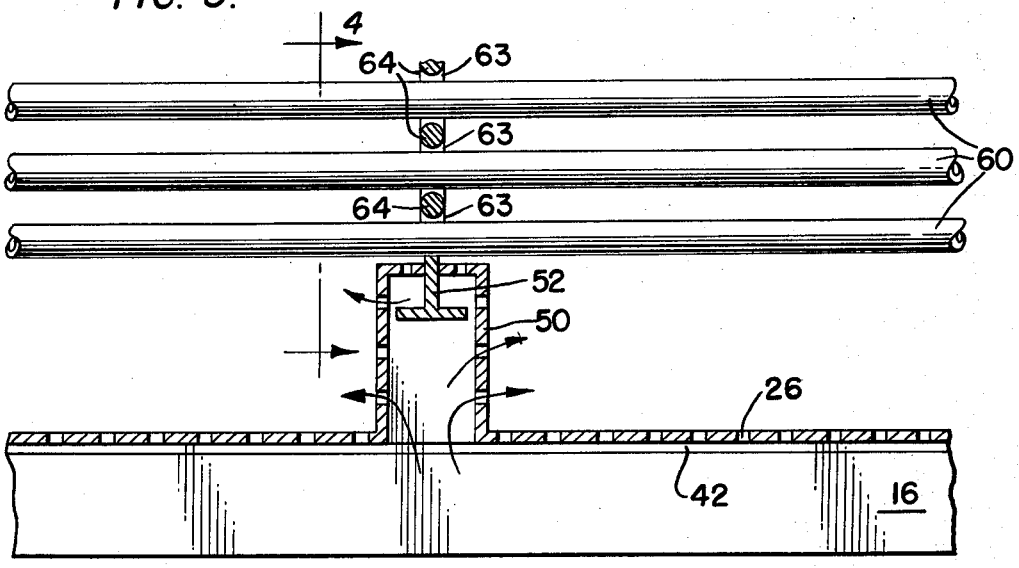
FIG. 3 is an enlarged partial, vertical sectional view of a portion of the structure shown in FIG. 1.

A support structure is provided above each pier 46, 48 and 50 for supporting the various sections of each heat exchange tube 60 relative to each other and is better shown in connection with pier 50 in FIGS. 3 and 4. In particular, the support structure consists of a plurality of plates 63 extending between the vertically adjacent sections of the tube sections, with each plate being welded at its ends to the lower surface and upper surface, respectively, of each tube section. A plurality of horizontally extending rods 64 are welded between adjacent plates to add structural stability to the support structure. This same support structure is also utilized in connection with the end portions of the sections of the heat exchange tubes 60 above the piers 46 and 48 as shown in FIG. 1. It is noted that in the latter cases, the support structure, i.e., the support plates 63 and the rods 64, extend between every other section of the tubes 60 since a support structure is not necessary between the tube sections adjacent the respective bends in the tube.

An alternate embodiment of the support structure for supporting adjacent sections of the tubes 60 is shown in FIGS. 5 and 6. In particular, instead of the plates 63 and support rods 64 utilized in the aforementioned embodiment, each tube section is provided with an annular ring 66 which extends around the tube section and which engages the corresponding annular ring disposed on the vertically adjacent tube section. In this manner, the sections of the tubes 60 are supported relative to each other immediately above the piers 46, 48 and 50, with each tube section being provided with the annular ring 66 in the area above the support pier 50 and with every other tube section being provided with an annular ring in the area above the support piers 46 and 48 for the reasons indicated above.

The embodiment of FIG. 7 is identical to that of FIG. 6 with the exception that in the former embodiment, the tube sections of a particular tube 60 are vertically offset from those of its adjacent tubes with the annular rings 66 abutting as in the previous embodiment to provide the support.

Figure 8:
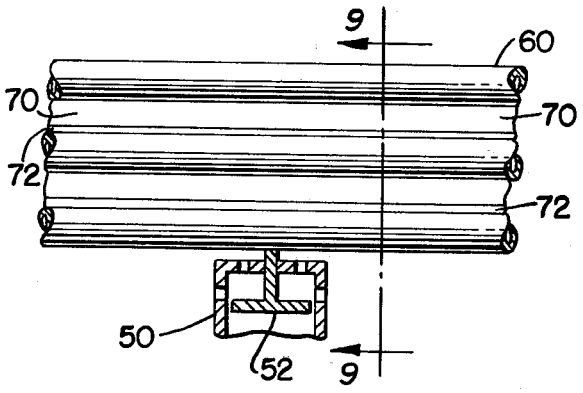
FIG. 8 is a view similar to FIG. 5 but depicting still another alternative embodiment of the present invention.
Figure 9:
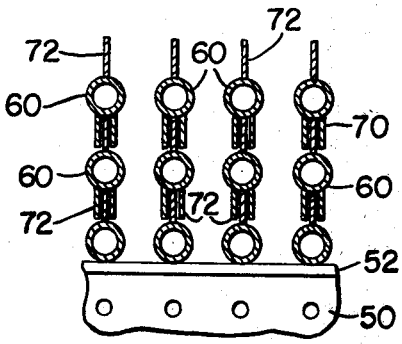
FIG. 9 is a sectional view taken along the line 9—9 of FIG. 8.

In the embodiment of FIGS. 8 and 9, the sections of the adjacent tubes 60 are disposed in horizontal alignment and two fins 70 extend from the lower portion of each tube section (with the exception of the lowermost sections) and a single fin 72 extends from the upper portion of each section (with the exception of the uppermost sections). The fin 72 extends between the two fins 70 of the vertically adjacent tube sections with the length or height of the fins 72 being dimensioned to correspond to the optimum vertical distance between adjacent tube sections. The fins 70 are slightly smaller in length than the fins 72 and operate to limit the relative horizontal movement of the fins 72 and therefore the horizontal movement between the adjacent tube sections.

Figure 10:
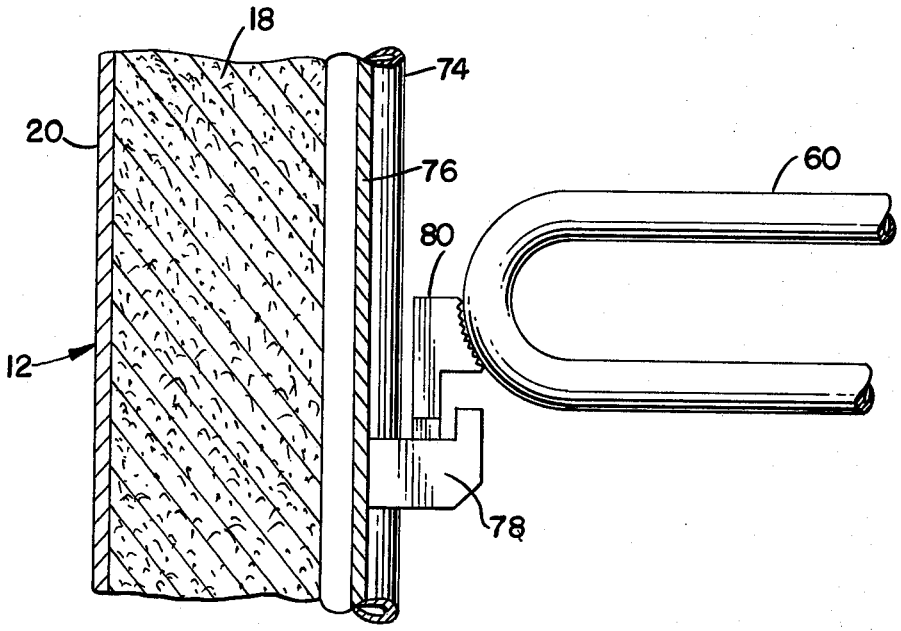
FIG. 10 is an enlarged partial sectional view of a support structure for the heat exchange tubes in accordance with a further alternative embodiment of the present invention.

The embodiment of FIG. 10 is designed to provide a support structure for the end portions of the tube sections in a configuration in which the inner plates forming the inner portion of the walls 12, 14 and 16 of the previous embodiments are replaced by a plurality of spaced tubes 74. Each tube 74 has a fin 76 disposed integral with, or welded to, the tube at diametrically opposed sections of the tube and extending for the entire length thereof. Although not clear from the drawings it is understood that the fins extending between adjacent tubes are connected together to form a gas-tight structure forming the inner portion of each of the walls 12, 14 and 16.

According to this embodiment, the piers 46 and 48 and the support structure associated therewith are replaced by a plurality of fingers 78 which are welded to the fins extending between adjacent tubes. A plurality of support lugs 80 are provided with each being supported by a corresponding finger 78 and each having a knurled portion 82 that engages the bent portions of the heat exchange tubes 60 as shown. A finger 78 and support lug 80 would be utilized in connection with each bent section of each heat exchange tube 60 and would be connected in the appropriate place along the lengths of several of the fins 76 extending between adjacent tubes.

It is thus seen that, according to each of the foregoing embodiments of the present invention, the heat exchange tubes are supported above the grid plate in a manner to permit cooling air to flow over those portions of the tubes supported relative to the grid plate and the various sections of the heat exchange tubes are supported relative to each other to prevent sagging of the sections.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A fluidized bed heat exchanger comprising a housing, a grid plate supported in said housing for receiving a bed of particulate material at least a portion of which is combustible, at least one perforated support pier means formed by bending portions of said grid plate and projecting out from the surface of said grid plate, means for passing air through said grid plate, said pier means and said material to fluidize said material, and at least one heat exchange tube extending within said housing and supported by said pier means so that the air passing through said pier means also passes over said tube, said pier means including a support beam extending within said bent portions of said grid plate and having a flange projecting outwardly for receiving said tube.

2. The heat exchanger of claim 1 wherein a plurality of said pier means are located along two opposite edges of said grid plate and along said grid plate at a location between said edges.

3. The heat exchanger of claims 1 or 2, wherein there are a plurality of tubes each extending in a serpentine manner to form a plurality of spaced parallel sections, and further comprising a support structure extending between adjacent sections of each tube.

4. The heat exchanger of claim 3, wherein said support structure comprises a plate extending between said adjacent sections and a support rod extending between and connected to adjacent plates.

5. The heat exchanger of claim 3, wherein said support structure comprises an annular flange extending around each section of each tube and engaging the flange of an adjacent section.

6. The heat exchanger of claim 3, wherein said support structure comprises at least one pair of spaced plates extending from the lower portion of at least a portion of said tube section and at least one plate extending from the upper portion of at least a portion of said tube sections and adapted to extend between said pair of plates.

7. The heat exchanger of claim 1, wherein there are a plurality of tubes each extending in a serpentine manner and wherein said support pier means is adapted to support said tubes at a point intermediate the bent portions of said tubes.

8. The heat exchanger of claim 7, further comprising a plurality of support members connected to the inner wall of said housing, and a support lug supported by a support member and adapted to engage a bent portion of one of said tubes to support the bent portions of said tubes.

9. A fluidized bed heat exchanger comprising a housing, a grid plate supported in said housing for receiving a bed of particulate material at least a portion of which is combustible, means for passing air through said grid plate and said material to fluidize said material, at least one heat exchange tube extending within said housing in a serpentine manner to form a plurality of spaced parallel sections, means for supporting said tube relative to said grid plate so that the air passing through said grid plate also passes over said tube, said supporting means comprising at least one support pier formed by bending portions of said grid plate and a support beam extending within said bent portions of said grid plate and having a flange projecting outwardly for receiving said tube, and a support structure extending between adjacent sections of said tube to support said sections relative to each other.

10. The heat exchanger of claim 9 wherein said supporting means are located along two opposite edges of said grid plate and along said grid plate at a location between said intermediate edges.

11. The heat exchanger of claim 9, wherein said support structure comprises a plate extending between said adjacent sections and a support rod extending between and connected to adjacent plates.

12. The heat exchanger of claim 9, wherein said support structure comprises an annular flange extending around each section of each tube and engaging the flange of an adjacent section.

13. The heat exchanger of claim 9, wherein said support structure comprises at least one pair of spaced plates extending from the lower portion of at least a portion of said tube section and at least one plate extending from the upper portion of at least a portion of said tube sections and adapted to extend between said pair of plates.

14. The heat exchanger of claim 9, wherein said supporting means is adapted to support said tubes at a point intermediate the bent portions of said tubes.

15. The heat exchanger of claim 14, further comprising a plurality of support members connected to the inner wall of said housing, and a support lug supported by a support member and adapted to engage a bent portion of one of said tubes to support the bent portions of said tubes.

16. The heat exchanger of claim 9, wherein said support structure extends immediately above said supporting means.

17. A fluidized bed heat exchanger comprising a housing, a grid plate support in said housing for receiving a bed of particulate material at least a portion of which is combustible, means for passing air through said grid plate and said material to fluidize said material, at least one heat exchange tube extending within said housing in a serpentine manner to form a plurality of spaced parallel sections, means for supporting said tube relative to said grid plate so that the air passing through said grid plate also passes over said tube, and a support structure extending between adjacent sections of said tube to support said sections relative to each other, said support structure comprising a plurality of plates, each plate extending between and terminating at said adjacent sections and a plurality of support rods, each support rod extending between and immovably connected to adjacent plates.

* * * * *